US011278090B2

(12) United States Patent
Oh

(10) Patent No.: US 11,278,090 B2
(45) Date of Patent: Mar. 22, 2022

(54) PORTABLE COMPACT UMBRELLA

(71) Applicant: Yong Kyun Oh, Seoul (KR)

(72) Inventor: Yong Kyun Oh, Seoul (KR)

( * ) Notice: Subject to any disclaimer, the term of this patent is extended or adjusted under 35 U.S.C. 154(b) by 0 days.

(21) Appl. No.: 16/924,171

(22) Filed: Jul. 8, 2020

(65) Prior Publication Data

US 2021/0015224 A1 Jan. 21, 2021

(30) Foreign Application Priority Data

Jul. 18, 2019 (KR) ..... 10-2019-0087062

(51) Int. Cl.

| | |
|---|---|
| ***A45B 25/14*** | (2006.01) |
| ***A45B 19/04*** | (2006.01) |
| *A45B 19/00* | (2006.01) |
| *A45B 23/00* | (2006.01) |

(52) U.S. Cl.

CPC ..... *A45B 25/14* (2013.01); *A45B 19/04* (2013.01); *A45B 2019/002* (2013.01); *A45B 2023/0006* (2013.01); *A45B 2023/0012* (2013.01); *A45B 2023/0087* (2013.01)

(58) Field of Classification Search

CPC . A45B 2023/0087; A45B 19/00; A45B 25/14; A45B 19/04

USPC ..... 135/19.5

See application file for complete search history.

(56) References Cited

U.S. PATENT DOCUMENTS

| | | | | | |
|---|---|---|---|---|---|
| 1,349,281 | A | * | 8/1920 | King | A45B 19/00 135/25.3 |
| 1,833,004 | A | * | 11/1931 | Spiro | A45B 19/00 135/25.4 |

FOREIGN PATENT DOCUMENTS

| | | | | | |
|---|---|---|---|---|---|
| CN | 201223043 | Y | | 4/2009 | |
| CN | 101631481 | A | | 1/2010 | |
| CN | 206462547 | U | | 9/2017 | |
| DE | 102011120999 | A1 | * | 6/2013 | A45B 25/02 |
| EP | 0444965 | A1 | * | 9/1991 | A45B 19/00 |
| FR | 676572 | A | * | 2/1930 | A45B 13/00 |
| FR | 2637470 | A1 | | 4/1990 | |
| GB | 1256901 | A | * | 12/1971 | A45B 19/00 |
| JP | S436746 | | | 3/1968 | |
| JP | S5979014 | U | | 5/1984 | |
| KR | 200199472 | Y1 | | 10/2000 | |
| KR | 20090084075 | A | | 8/2009 | |
| KR | 20150017847 | A | | 2/2015 | |
| KR | 101790469 | B1 | | 10/2017 | |
| KR | 20180005014 | A | | 1/2018 | |
| KR | 101866699 | B1 | | 6/2018 | |
| RU | 2011129296 | A | | 1/2013 | |
| TW | I655919 | B | | 4/2019 | |

* cited by examiner

*Primary Examiner* — Noah Chandler Hawk

(74) *Attorney, Agent, or Firm* — Renaissance IP Law Group LLP

(57) ABSTRACT

Provided is a portable compact umbrella including a case having an inner accommodation space and opened one side, a roller rotatably installed in the case, a support having a variable length and configured to support the case, and an umbrella part accommodated in the accommodation space by passing through an opening at one side of the case in conjunction with rotation of the roller, to reduce an accommodation volume and be easily accommodated and unfolded.

14 Claims, 19 Drawing Sheets

(a)

(b)

(a)

(b)

PORTABLE COMPACT UMBRELLA

CROSS-REFERENCE TO RELATED APPLICATION

This application claims priority to Korean Patent Application No. 10-2019-0087062 filed on Jul. 18, 2019 and all the benefits accruing therefrom under 35 U.S.C. § 119, the contents of which are incorporated by reference in their entirety.

BACKGROUND

The present disclosure relates to a portable compact umbrella, and more particularly, to a portable compact umbrella capable of reducing an accommodation volume.

In general, an umbrella includes an umbrella shaft having a bar shape, an umbrella frame capable of being unfolded in a radial direction with respect to the umbrella shaft, and an umbrella fabric covering the umbrella frame to prevent snow and rain from being inserted between the umbrella frame.

A user who is supposed to go out or have outdoor activity carries the umbrella when rain is expected by checking weather information. Here, as an accommodation volume of the umbrella decreases, the user may easily carry the umbrella, and activity of the user may improve.

A typical umbrella is inevitably unfolded several times into a maximally small size and increases in number of folding the umbrella frame in order to reduce the accommodation volume. However, as the number of folding the umbrella frame increases, the umbrella frame may have a complex structure, and thus an accommodation volume to be gripped by one hand may be hardly realized.

The background technology of the present invention is disclosed in the patent documents below.

RELATED ART

Patent Document (Patent document 1) KR10-1866699 B1
(Patent document 2) KR10-1790469 B1

SUMMARY

The present disclosure provides a portable compact umbrella capable of reducing an accommodation volume.

The present disclosure also provides a portable compact umbrella that is easily accommodated and unfolded.

In accordance with an exemplary embodiment, a portable compact umbrella includes: a case having an inner accommodation space and opened one side; a roller rotatably installed in the case; a support having a variable length and configured to support the case; and an umbrella part accommodated in the accommodation space by passing through an opening at one side of the case in conjunction with rotation of the roller.

The case may include: a container body having an opened upper or lower portion and including the opening at a side surface thereof; and a lid mounted to the upper or lower portion of the container body.

A slit may be defined in the side surface of the container body, and the slit may pass through the side surface of the container body, communicate with the opening, and extend upward or downward from the opening.

The roller may have an opened lower portion, pass through a central portion of a bottom surface or a top surface of the container body, and be aligned with the support.

The support may be rotated in conjunction with the roller and have at least an upper end accommodated in the roller and a lower end protruding downward.

The umbrella part may include: an umbrella fabric having a size covering a body of a user; an umbrella ring separated from the support and installed at a circumference of the umbrella fabric; and a connection rope configured to connect at least one of the umbrella ring and the umbrella fabric with the roller to interconnect the rotation of the roller with movement of the umbrella ring.

The umbrella fabric may be unfolded in a radial direction and have a central portion attached to and detached from a top surface of the case, and both sides of a cut portion, which is obtained as one side of a circumference is cut in the radial direction, may overlap each other.

Both sides of a top surface of the umbrella fabric may overlap each other with respect to an area line passing the central portion of the umbrella fabric and the cut portion, and the umbrella fabric may pass through the opening at one side of the case in conjunction with the movement of the umbrella ring and be wound around the roller to be accommodate in the accommodation space.

The umbrella ring may be disposed on a bottom surface of the umbrella fabric, a cover fabric may be provided at a circumference of the bottom surface of the umbrella fabric to cover the umbrella ring, a plurality of grooves may be formed at an opposite side of the cut portion of the umbrella fabric, and a central portion between one end and the other end of the umbrella ring may pass through the groove and be exposed to a top surface of the umbrella fabric.

As one side of the umbrella ring is cut, the umbrella ring may have both ends that face each other.

The umbrella ring may have an arc-type structure.

The umbrella ring may have one end disposed at one side of the cut portion of the umbrella fabric and the other end disposed at the other side of the cut portion of the umbrella fabric, and the both ends may overlap each other as the both sides of the cut portion overlap each other.

The umbrella ring may include a material capable of being deformed and restored and unfold the umbrella fabric in the radial direction by using a restoration force.

The connecting rope may have one end connected to at least one of one end of the umbrella ring and one side of the cut portion of the umbrella fabric and the other end connected to the roller and wound around or unwound from the roller, to pull the umbrella ring and the umbrella fabric into the case.

The umbrella part may include: a coupling member provided at the central portion of the umbrella fabric, and attached to and detached from the case; and a plurality of fixing members provided at both sides of the cut portion of the circumference of the umbrella fabric, respectively, and attached to and detached from each other while contacting each other.

The plurality of fixing members are spaced apart from each other at both sides of the cut portion. The plurality of fixing members are disposed on the top surface of the umbrella fabric at one side of the cut portion and disposed on the top and bottom surfaces of the umbrella fabric, respectively, at the other side of the cut portion.

The fixing members disposed on the top and bottom surfaces of the umbrella fabric, respectively, at the other side of the cut portion may be spaced apart from each other along the circumference of the umbrella fabric.

The fixing member disposed on the top surface of the umbrella fabric at one side of the cut portion and the fixing member disposed on the bottom surface of the umbrella fabric at the other side of the cut portion may be attached to each other when the umbrella fabric is unfolded, and the fixing member disposed on the top surface of the umbrella fabric at one side of the cut portion and the fixing member disposed on the top surface of the umbrella fabric at the other side of the cut portion may be attached to each other when the umbrella fabric is accommodated.

The portable compact umbrella may further include a door mounted to the case to open and close the opening.

The portable compact umbrella may further include a reverse rotation preventing part installed between the roller and the case to prevent reverse rotation of the roller.

BRIEF DESCRIPTION OF THE DRAWINGS

Exemplary embodiments can be understood in more detail from the following description taken in conjunction with the accompanying drawings, in which.

DETAILED DESCRIPTION OF EMBODIMENTS

Figure 1:
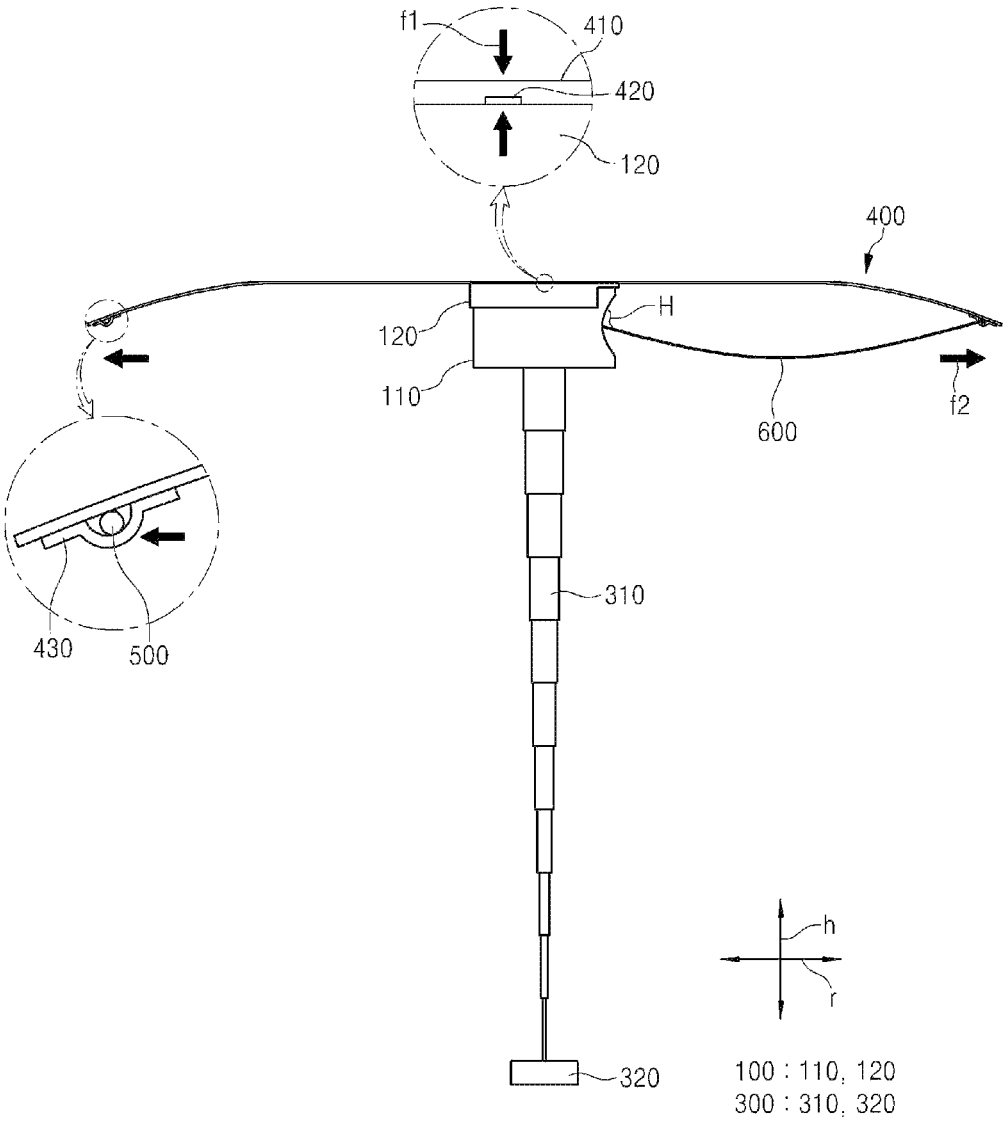
FIG. 1 is a schematic view illustrating a portable compact umbrella in accordance with an exemplary embodiment.

Hereinafter, embodiments of the present invention will be described in detail with reference to the accompanying drawings. The present invention may, however, be embodied in different forms and should not be construed as limited to the embodiments set forth herein. Rather, these embodiments are provided so that this disclosure will be thorough and complete, and will fully convey the scope of the present invention to those skilled in the art. In the figures, the dimensions of layers and regions are exaggerated for clarity of illustration. Like reference numerals refer to like elements throughout.

Figure 2:
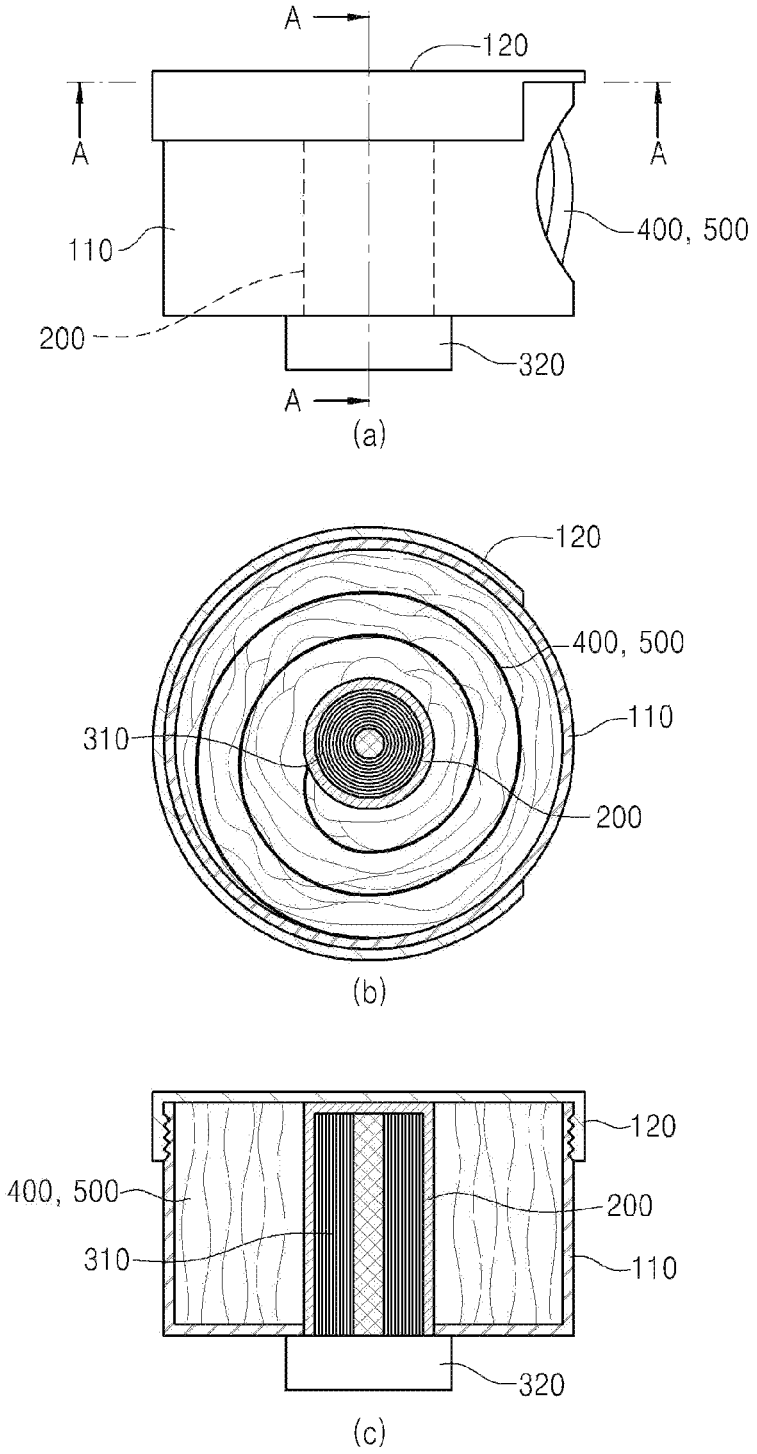
FIG. 2 is a state view illustrating a storage state of the portable compact umbrella in accordance with an exemplary embodiment.
Figure 3:
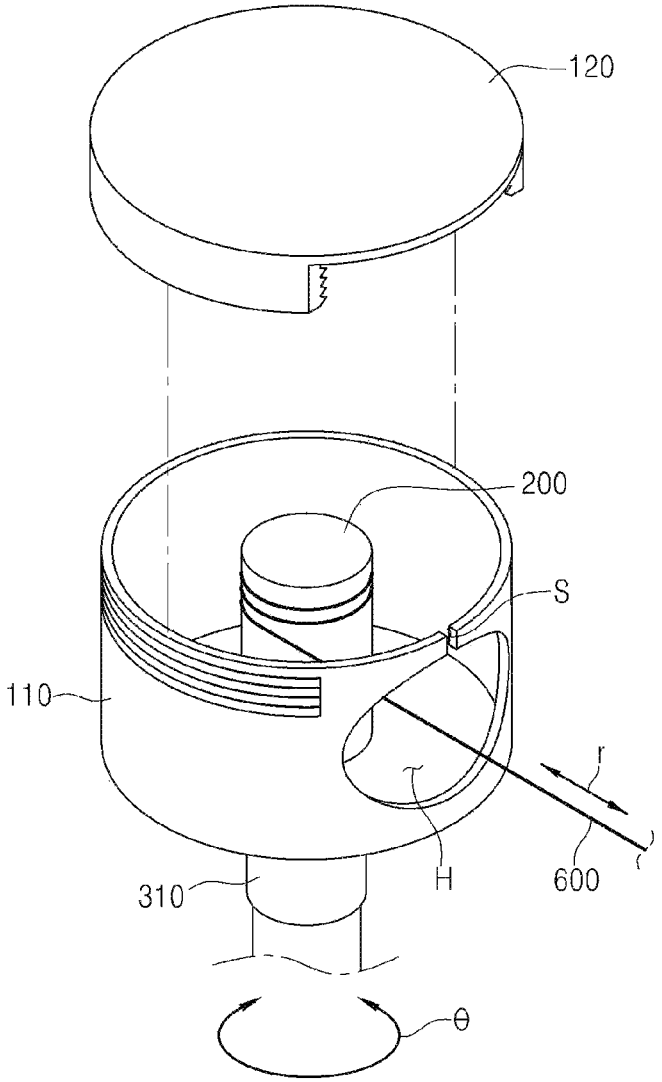
FIG. 3 is a perspective view illustrating a case and a roller in accordance with an exemplary embodiment.

FIG. 1 is a schematic view illustrating a portable compact umbrella in accordance with an exemplary embodiment, (a), (b), and (c) of FIG. 2 are state views illustrating a storage state of the portable compact umbrella in accordance with an exemplary embodiment, and FIG. 3 is a perspective view illustrating a case and a roller in accordance with an exemplary embodiment.

The portable compact umbrella in accordance with an exemplary embodiment includes: a case 100 having an accommodation space therein and one opened side; a roller 200 rotatably installed in the case 100; a support 300 having a variable length and supporting the case 100; and umbrella parts 400, 500, and 600 accommodated in the accommodation space by passing through an opening H at one side of the case 100 and rotating of the roller 200.

Referring to FIGS. 1 and 2, the case 100 serves as a main body of the portable compact umbrella. The roller 200 may be installed in the case 100. An accommodation space may be formed between an inner surface of the case 100 and an outer circumferential surface of the roller 200.

The case 100 may have a cylindrical shape. Alternatively, the case 100 may have various shapes. The case 100 may extend by a predetermined height in a vertical direction h and extend by a predetermined width in a radial direction r. The case 100 may have a height in the vertical direction h less than a width in the radial direction r. That is, the case 100 may have a width grater than a height. Thus, when an umbrella fabric 400 and an umbrella ring 500 are pulled and wound in a vortex shape to be accommodated in the accommodation space, the umbrella fabric 400 and the umbrella ring 500 may be smoothly pulled.

The smooth pulling may be performed because a spaced distance between the outer circumferential surface of the roller 200 and the inner side surface of the case 100 may increase as the width of the case 100 increases more than the height in the same accommodation volume, and the umbrella fabric 400 and the umbrella ring 500 may smoothly move between the outer circumferential surface of the roller 200 and the inner side surface of the case 100.

Also, since the case 100 has a cylindrical shape, as the width is greater than the height, a user may easily put the case 100 into a pocket of a shirt or pants and easily grip the case 100 by hands. Alternatively, the case 100 may have a width less than a height.

The case 100 may have a height of several cm. For example, the case 100 may have a height of several cm so that users at various ages such as teenagers and adults easily grip the case 100 with one hand, and the umbrella fabric 400 is easily accommodated in the accommodation space.

The case 100 may have a width of several cm. That is, the case 100 may have a width of several cm so that users easily grip the case 100 with one hand, and the umbrella fabric 400 is easily accommodated in the accommodation space. Here, the case 100 may have the width grater than the height. That is, the case 100 may have a flat cylindrical shape.

As the case 100 has the above-described height and width, the user may easily grip the case 100 with one hand and also conveniently act while the case 100 put in the pocket of the shirt or the pants. Alternatively, the case 100 may have various widths and heights.

Referring to FIGS. 1 and 3, the case 100 may include a container body 110 and a lid 120. An upper or lower portion of the container body 110 may be opened. For example, the upper portion of the container body 110 may be opened. The container body 110 may include a bottom surface and a side surface. An opening H may be defined in the side surface of the container body 110.

The opening H may pass through the side surface of the container body 110 in the radial direction r. The opening H may have an oval shape. Alternatively, the opening H may have various shapes in addition to the oval shape. The accommodation space and the container body 110 may communicate each other through the opening H. A connection rope 600 may be disposed in the opening H. The umbrella fabric 400 and the umbrella ring 500 may pass through the opening H by pulling the connection rope 600.

The lid 120 may be mounted to the upper or lower portion of the container body 110. When the upper portion of the container body 110 is opened, the lid 120 may be mounted to the upper portion of the container body 110. Here, the lid 120 may be screw-coupled to the upper portion of the container body 110. Thus, the lid may be easily and quickly mounted to and detached from the container body 110. When the lid 120 is detached from the container body 110, the umbrella fabric 400 and the umbrella ring 500, which are accommodated in the accommodation space with the vortex shape, may be pulled out of the container body 110 and quickly unfolded. Here, the unfolding represents a feature of unfolding the umbrella fabric 400 into a shape, e.g., a circular plate or a semi-sphere, in a wide and tight manner.

The lid 120 may include a top surface and a side surface. The side surface of the lid 120 may be partially cut to avoid structural interference with the opening H.

In the lid 120, at least a central portion of the top surface may include a magnetic material. Here, the magnetic material may include, e.g., a metal material that is attachable to a magnet. Thus, a coupling member 420 provided at a central portion of the umbrella fabric 400, which will be described later, may be attached to and detached from the lid 120 with one touch by using a magnetic force f1.

A slit S through which the connection rope 600 passes may be defined in a side surface of the container body 110. The slit S may be defined in a circumference of the opening H and extend upward or downward from the opening H. The slit S may be defined to pass the side surface of the container body 110 in the radial direction r and extend in the vertical direction h between the opening H and the lid 120. The slit S may have a lower end communicating with the opening H and an upper end that is opened upward. The connection rope 600 may freely move into or out of the opening H through the slit S.

Referring to FIGS. 2 and 3, the roller 200 may have a cylindrical shape. The roller 200 may extend in the vertical direction h. The roller 200 may pass through the container body 110 in the vertical direction h. The roller 200 may pass through a central portion of a top surface or a bottom surface of the container body 110. For example, when the container body 110 has an opened top surface, the roller 200 may pass through the central portion of the bottom surface of the container body 110. The roller 200 may have an opened lower portion, and the support 300 may be accommodated in the roller 200. The roller 200 may be aligned with the support 300 in the vertical direction h. The umbrella fabric 400 and the umbrella ring 500 may be wound in a vortex shape and accommodated at an outer circumferential surface of the roller 200. Here, the bottom surface of the container body 110 may support the umbrella fabric 400 and the umbrella ring 500 at the same height, and the umbrella fabric 400 and the umbrella ring 500 may overlap the outer circumferential surface of the roller 200 with a plurality of layers.

Referring to FIGS. 1 and 2, the support 300 may be stretchable in the vertical direction h, e.g., may have a variable length in the same manner as a rod antenna. Here, the same manner as the rod antenna represents a method of adjusting the length such that metal pipes having different diameters are arranged in a height direction and then sequentially connected to overlap each other, and a degree of overlap thereof is adjusted. Alternatively, the support 300 may have various stretching methods.

The support 300 may include: a stretching member 310 having multi-stages that are arranged in the vertical direction h and having a length that is variable by adjusting a degree of mutual overlap; and a handle member 320 mounted to a lower portion of the stretching member 310 and being gripped by hands of the user. The stretching member 310 may include a plurality of hollow pipes connected to each other in the vertical direction h. The plurality of hollow pipes may include a groove (not shown) and a projection (not shown) at each of contact portions thereof and maintain a length in stretched and contracted states by using the same. The stretching member 310 may have a diameter that decrease by stages in a downward direction. The stretching member 310 may have at least an upper end accommodated in the roller 200 and a lower end protruding downward. The handle member 320 may be mounted to the lower end of the stretching member 310.

As described above, the support 300 serves to support the case 100 and rotate the roller 200. Here, the support 300 may be rotated in conjunction with the roller 200. That is, the roller 200 may be rotated by rotating the support 300.

Figure 4:
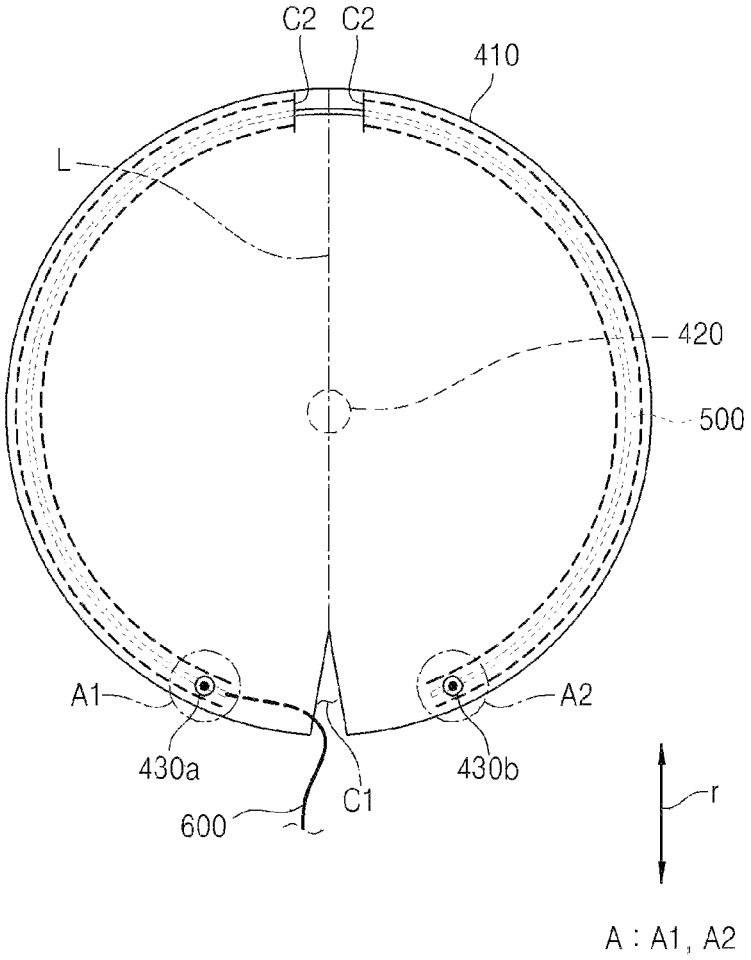
FIG. 4 is a plan view illustrating an umbrella ring and an umbrella fabric in accordance with an exemplary embodiment.
Figure 5:
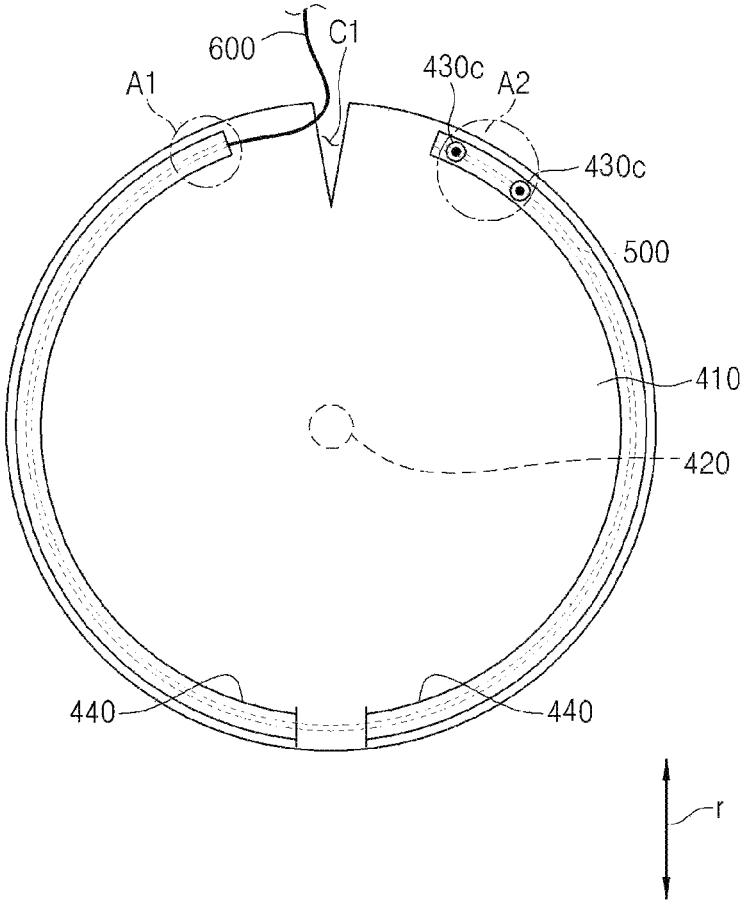
FIG. 5 is a bottom view illustrating the umbrella ring and the umbrella fabric in accordance with an exemplary embodiment.
Figure 6:
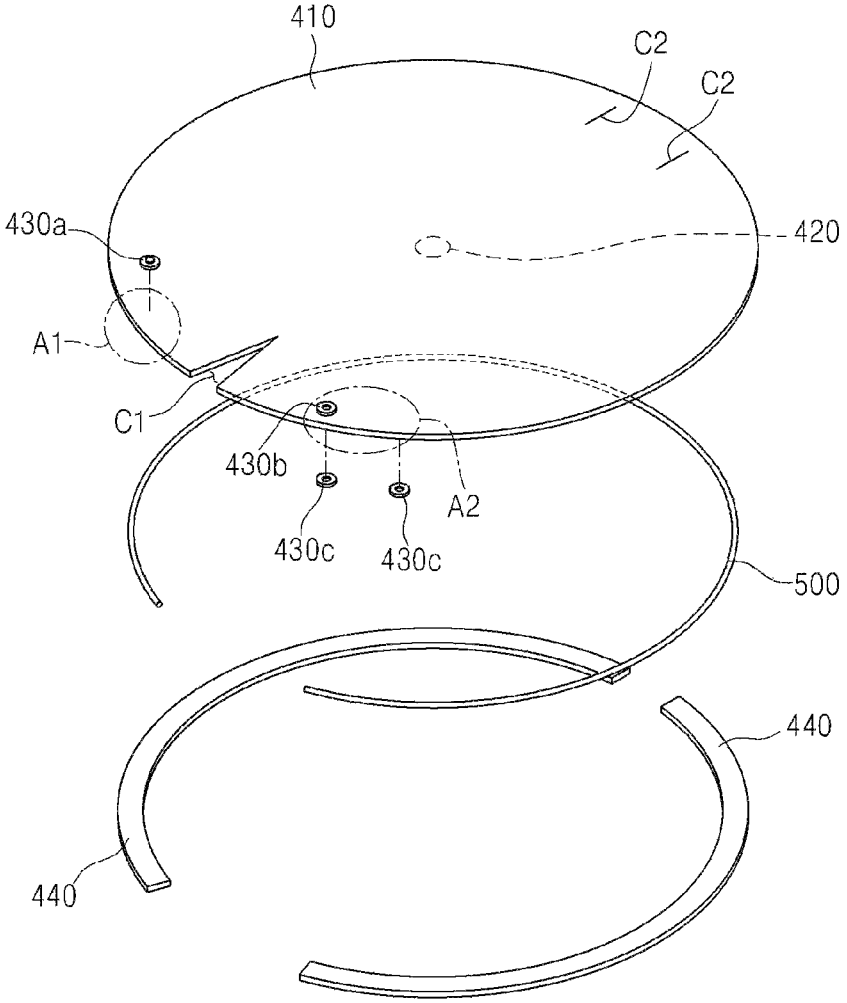
FIG. 6 is an exploded perspective view illustrating the umbrella ring and the umbrella fabric in accordance with an exemplary embodiment.
Figure 7:
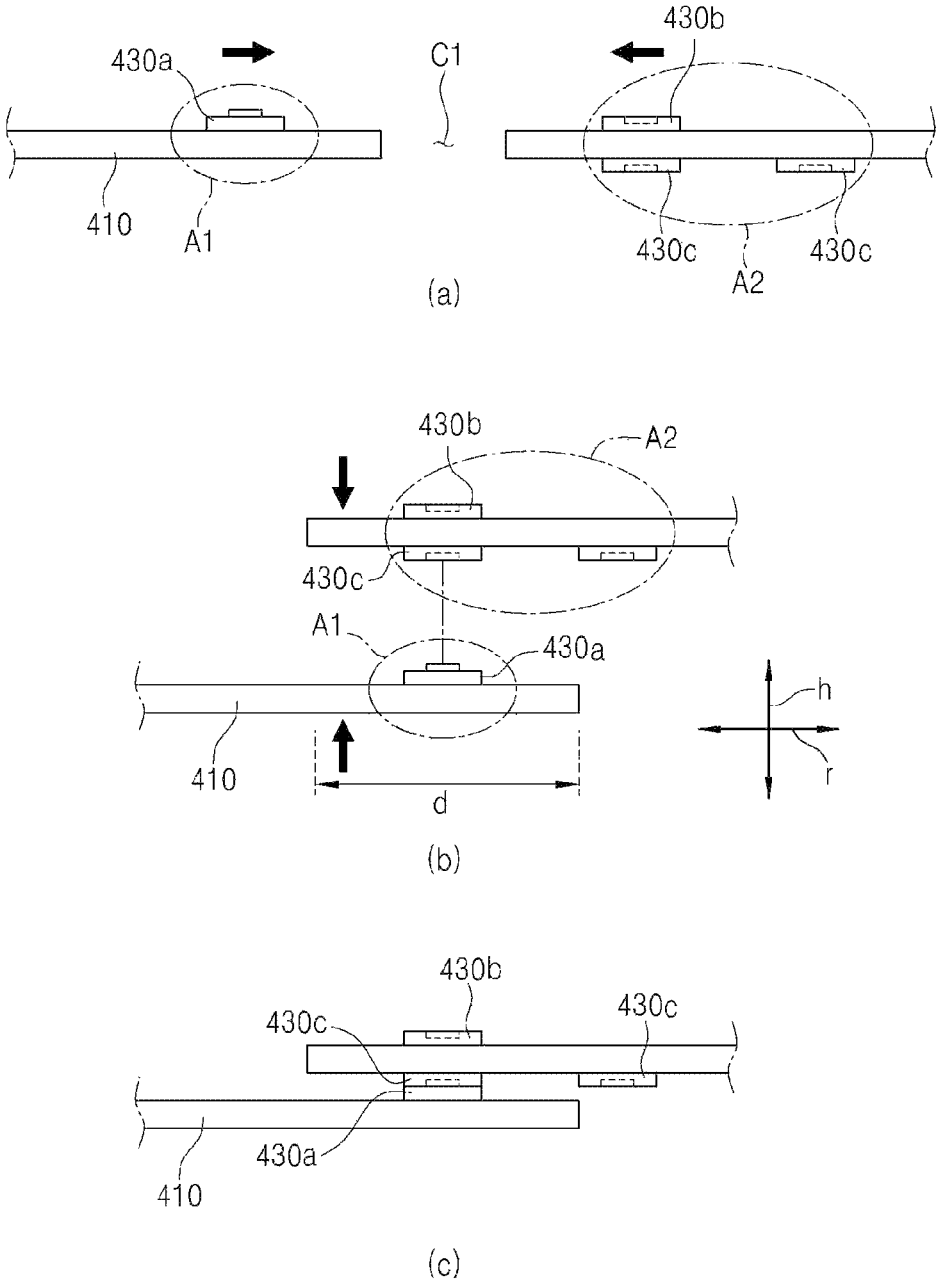
FIG. 7 is a schematic view illustrating the umbrella ring and the umbrella fabric in accordance with an exemplary embodiment.

FIG. 4 is a plan view illustrating the umbrella ring and the umbrella fabric in accordance with an exemplary embodiment, FIG. 5 is a bottom view illustrating the umbrella ring and the umbrella fabric in accordance with an exemplary embodiment, FIG. 6 is an exploded perspective view illustrating the umbrella ring and the umbrella fabric in accordance with an exemplary embodiment, and (a), (b), and (c) of FIG. 7 are schematic views illustrating the umbrella ring and the umbrella fabric in accordance with an exemplary embodiment.

The umbrella part 400, 500, and 600 may include: an umbrella fabric 400 having a size capable of covering the body of the user; an umbrella ring 500 separated from the support 300 and installed at the circumference of the umbrella fabric 400; and a connection rope 600 connecting the roller 200 and the umbrella ring 500 to interconnect rotation of the roller 200 with movement of the umbrella ring 500.

The umbrella ring 500 may have, e.g., an arc-type structure and be installed at the circumference of the umbrella fabric 400. The connection rope 600 may be connected to at least one of the umbrella ring 500 and the umbrella fabric 400 and pull the ring 500 and the umbrella fabric 400 into the case 100 while being wound around the roller 200.

The arc-type structure may be the same as a ring having both ends facing each other as one side thereof is cut. The ring may include various shapes such as a circular ring, a rectangular ring, and a triangular ring. When the ring is a circular ring, the arc-type structure may be referred to as a circular arc-type structure. Since one umbrella ring 500 having the arc-type structure may support the circumference of the umbrella fabric 400, the portable compact umbrella may secure a support force necessary for unfolding the umbrella fabric 400, easily wind the umbrella fabric 400 and the umbrella ring 500 in the case 100, and reduce an accommodation volume thereof.

Also, the umbrella part may include: a coupling member 420 provided at the central portion of the umbrella fabric 400 and attached to and detached from the case 100; and a plurality of fixing members 430*a*, 430*b*, and 430*c* provided at both sides A of a cut portion of the circumference of the umbrella fabric 400, respectively, and attached to and detached from each other while contacting each other.

Referring to FIGS. 4 to 7, the umbrella fabric 400 may be supported by the top surface of the case 100 and accommodated in the case 100. The umbrella fabric 400 may include: a covering member 410 having a size capable of covering the body of the user, having a central portion that is attached to and detached from the top surface of the case 100, and having one side of a circumference in the radial direction r, which is cut so that both sides A of the cut portion overlap each other; a coupling member 420 provided at the central portion of the covering member 410 and attached to and detached from the case 100 by using a magnetic force; a plurality of fixing members 430*a*, 430*b*, and 430*c* provided at the both sides A of the cut portion of the circumference of the covering member 410, respectively, and attached to and detached from each other while contacting each other; and a cover fabric 440 disposed on a bottom surface of the covering member 410 and extending along the circumference of the covering member 410 in a circumferential direction θ to cover the umbrella ring 500.

The covering member 410 may include a material such as waterproof cloth and vinyl to hide snow, rain, light, and wind. The covering member 410 may be disposed outside the case 100 and unfolded in the radial direction r, pass through the opening H at one side of the case in conjunction with the movement of the umbrella ring 500, and wound around the roller 200 and accommodated in the accommodation space in the case 100. Here, the above-described movement represents movement in a direction crossing the vertical direction h. The direction crossing the vertical direction h may include the radial direction r. The covering member 410 may have various shapes such as a circle, an oval, and a polygon in a state of being unfolded in the radial direction r.

Both sides of a top surface of the covering member 410 may be folded with respect to an area line L passing a cut portion C1 and the central portion of the covering member 410 so that the covering member 410 is easily accommodated. The umbrella ring 500 may be disposed on the bottom surface of the covering member 410. A plurality of grooves C2 may be defined at an opposite side of the cut portion C1 of the covering member 410, and a central portion between one end and the other end of the umbrella ring 500 may pass the groove C2 and exposed to a top surface of the covering member 410.

The covering member 410 may have a predetermined width in the radial direction r to cover the body of the user and be easily accommodated in the case 100. For example, the covering member 410 may have a width of several cm. Alternatively, the covering member 410 may have various widths.

The coupling member 420 may be provided at the central portion of the covering member 410 and include, e.g., a magnet. Here, the magnet may be made of a flexible material. For example, the magnet may be a rubber magnet having a circular plate shape. Alternatively, the magnet may include various kinds. The magnet may be a neodymium circular magnet. The coupling member 420 may attach and detach the covering member 410 to and from the case 100.

Here, the coupling member 420 may have various methods for attaching and detaching the covering member 410 to and from the case 100. For example, a method of using a button or a Velcro may be applied.

A plurality of fixing members may be spaced apart from each other toward the both sides A of the cut portion, disposed on the top surface of the covering member 410 at one side A1 of the cut portion, and disposed on the top surface and the bottom surface of the covering member 410 at the other side A2 of the cut portion. Here, a plurality of fixing members of the plurality of fixing members may be disposed on the bottom surface of the covering member 410 at the other side A2 of the cut portion and spaced apart from each other along the circumference of the covering member 410 (refer to FIG. 6).

The fixing member 430*a* disposed on the top surface of the covering member 410 at the one side A1 of the cut portion and the fixing member 430*c* disposed on the bottom surface of the covering member 410 at the other side A2 of the cut portion may be attached to each other when the covering member 410 is unfolded. Here, an overlap length d of the covering member 410 may be adjusted by adjusting an attachment position (refer to (a) to (c) of FIG. 7), and a supporting force f2 of the umbrella ring 500 may be adjusted (refer to FIG. 1).

The fixing member 430*a* disposed on the top surface of the covering member 410 at the one side A1 of the cut portion and the fixing member 430*b* disposed on the top surface of the covering member 410 at the other side A2 of the cut portion may be attached to each other when the covering member 410 is accommodated. Thus, the covering member 410 may be smoothly wound around the outer circumferential surface of the roller 200.

Here, the fixing member 430*a* disposed on the top surface of the covering member 410 at the one side A1 of the cut portion may be a female button including an insertion groove. In correspondence to this, each of the fixing members 430*b* and 430*c* disposed on the top surface and the bottom surface of the covering member 410 at the other side A2 of the cut portion may be a male button including an insertion projection that is inserted to the insertion groove. However, a structure and a method for coupling the plurality of fixing members may be variously provided.

The umbrella ring 500 may include both ends facing each other as one side thereof is cut. The umbrella ring 500 may include a circular ring in which one side is cut. That is, the exemplary embodiment is not specifically limited thereto. That is, the umbrella ring 500 may include a rectangular ring or a triangular ring in which one side is cut. The umbrella ring 500 may have a shape matched with that of the umbrella fabric 400. That is, when the umbrella fabric 400 has a circular shape, the umbrella ring 500 may have a circular ring structure, and when the umbrella fabric 400 has a rectangular shape, the umbrella ring 500 may have a rectangular ring structure.

The umbrella ring 500 may be disposed on a bottom surface of the umbrella fabric 400 and extend along a circumference of the bottom surface of the umbrella fabric 400. Also, the umbrella ring 500 may be protected by the cover fabric 440. The umbrella ring 500 may include a material capable of being deformed and restored. Thus, the umbrella ring 500 may unfold the umbrella fabric 400 in the radial direction r by using a restoration force. Thereafter, the umbrella ring 500 may maintain a shape of the umbrella fabric 400 before both sides of the umbrella fabric 400 is folded with respect to the area line L to accommodate the umbrella fabric 400 in the case 100.

The umbrella ring 500 may include a metal material and an alloy material. The umbrella ring 500 may include any material capable of being deformed and restored. For example, the umbrella ring 500 may include various materials capable of being bent and unbent and having elasticity such as a rubber material and a resin material.

One umbrella ring 500 may be provided. The umbrella ring 500 may have an arc-type structure. The umbrella ring 500 may have one end disposed at the one side A1 of the cut portion of the covering member 410 and the other end disposed at the other side A2 of the cut portion of the covering member 410, and the one end and the other end may be connected to or overlap each other as the both sides A of the cut portion overlap each other.

The umbrella ring 500 may have a diameter less than several mm Preferably, the umbrella ring 500 may have a diameter of several hundreds μm to several mm. When the umbrella ring 500 has a diameter equal to or greater than several mm, an accommodation volume of the umbrella fabric 400 and the umbrella ring 500 when accommodated may increase, and a force required when the umbrella fabric 400 and the umbrella ring 500 are wound around the outer circumferential surface of the roller 200 may increase. When the umbrella ring 500 has a diameter of several hundreds μm to several mm, the umbrella fabric 400 and the umbrella ring 500 may occupy a compact accommodation space when accommodated and be easily wound around the outer circumferential surface of the roller 200 by rotating the roller 200 with a less force.

The connection rope 600 may have one side connected to at least one of the one end of the umbrella ring 500 and the one side A1 of the cut portion of the umbrella fabric 400 and passing through the opening H at one side of the case 100. The connection rope 600 may have the other side connected to the roller 200. Specifically, the connection rope 600 may have the other side attached to the roller 200. Alternatively, various methods for connecting the other side of the connection rope 600 to the roller 200 may be provided. Also, the other side of the connection rope 600 may be wound around the outer circumferential surface of the roller 200 or unwound from the outer circumferential surface of the roller 200. The umbrella fabric 400 and the umbrella ring 500 may be pulled into the case 100 or the pulling may be released by adjusting a degree of winding the connection rope 600 around the roller 200. As the other side of the connection rope 600 is wound around the outer circumferential surface of the roller 200, the one side of the connection rope 600 may pull the umbrella fabric 400 and the umbrella ring 500 into the case 100.

Figure 8:
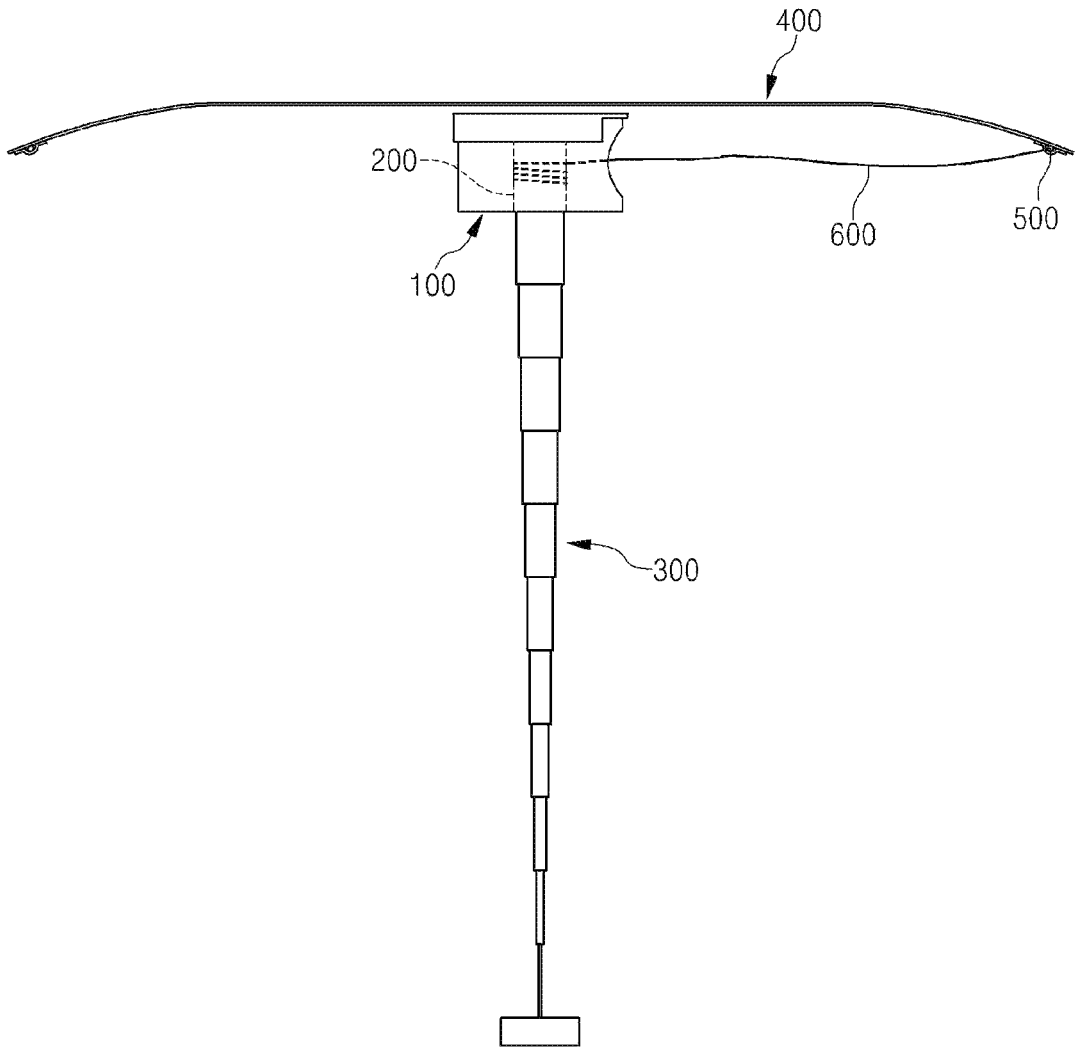
FIG. 8 is a state view illustrating a state of separating the umbrella fabric from the case in accordance with an exemplary embodiment.
Figure 9:
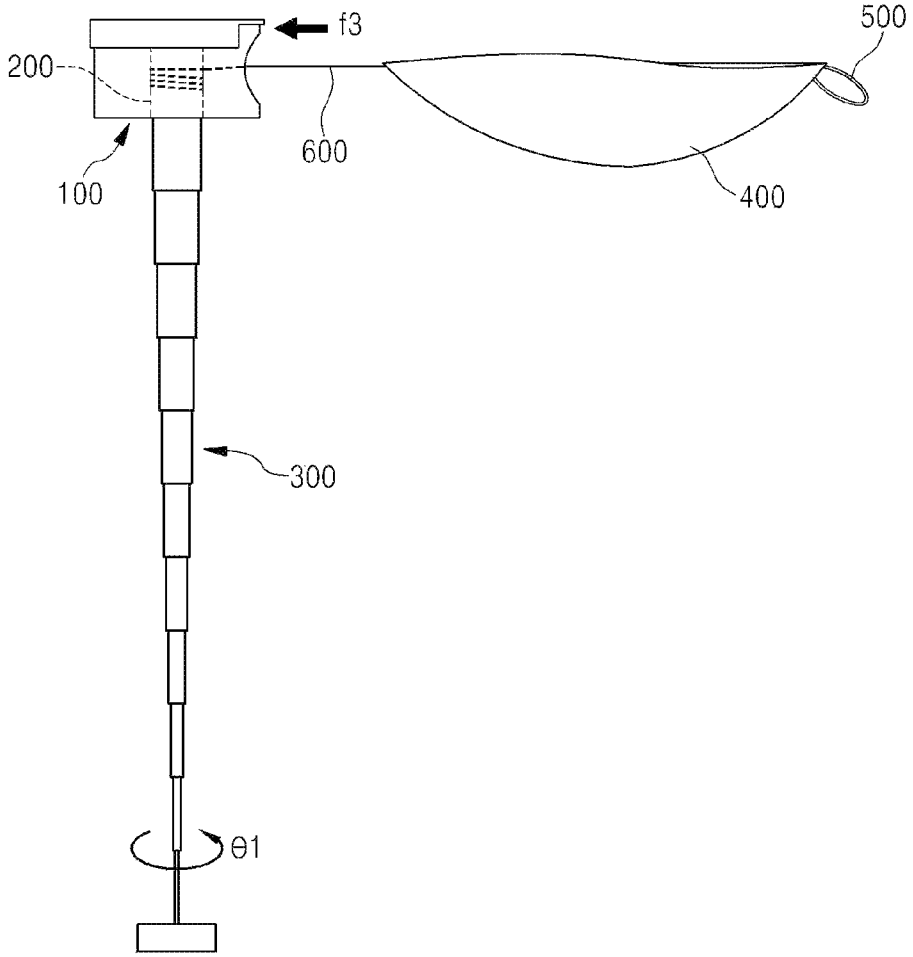
FIG. 9 is a state view illustrating a state of accommodating the umbrella fabric and the umbrella ring in the case in accordance with an exemplary embodiment.

FIG. 8 is a state view illustrating a state of separating the umbrella fabric from the case in accordance with an exemplary embodiment. FIG. 9 is a state view illustrating a state of accommodating the umbrella fabric and the umbrella ring in the case in accordance with an exemplary embodiment.

As described above, when the portable compact umbrella is not used for example, the support 300, the umbrella fabric 400, the umbrella ring 500, and the connection rope 600 may be accommodated in the case 100 to reduce an accommodation space thereof. Thus, the user may simply store and carry the portable compact umbrella (refer to FIG. 2).

Also, when the portable compact umbrella is used, the support 300, the umbrella fabric 400, the umbrella ring 500, and the connection rope 600 may be pulled out of the case 100. Thereafter, the support 300 may be unfolded downward from the case 100, and the umbrella fabric 400 and the umbrella ring 500 may be pulled out of the case 100 and unfolded in the radial direction r. That is, the portable compact umbrella may be easily and quickly unfolded (refer to FIG. 1).

When the portable compact umbrella is stored again, the umbrella fabric 400 and the umbrella ring 500 may be pulled into the case 100 by detaching the umbrella fabric 400 and the umbrella ring 500 from the top surface of the case 100 (refer to FIG. 8), folding the umbrella fabric 400 and the umbrella ring 500 into a half size so that both sides of the top surface of the umbrella fabric 400 are contact-folded, rotating θ1 the support 300 (refer to FIG. 9), and pulling the connection rope 600 connected to the umbrella ring 500. Thus, the umbrella fabric 400 and the umbrella ring 500 may be accommodated in the accommodation space of the case 100 and wound around the outer circumferential surface of the roller 200 with a vortex shape. Here, as the umbrella fabric 400 is pushed in a direction toward the case 100, and the central portion of the umbrella ring 500 is pulled by a predetermined length behind the umbrella fabric 400 that is a direction away from the case 100 before the support 300 is rotated, the central portion of the umbrella ring 500, which is a bent portion of the umbrella ring 500, may be spaced apart from the umbrella fabric 400, and the umbrella fabric 400 and the umbrella ring 500 may be further smoothly wound around the outer circumferential surface of the roller 200. Thereafter, the support 300 may be accommodated in the roller 200.

Figure 10:
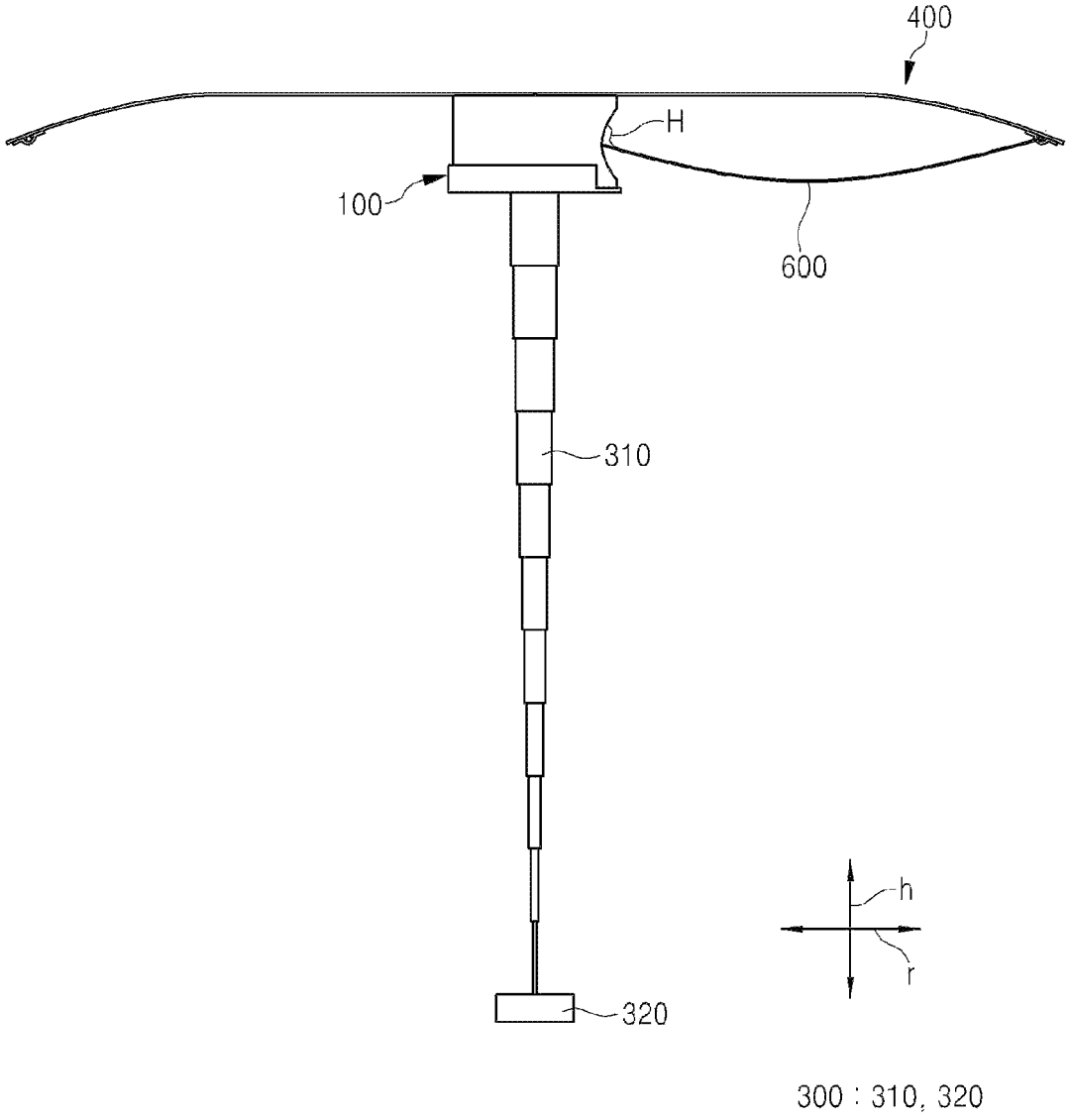
FIG. 10 is a schematic view illustrating a portable compact umbrella in accordance with another exemplary embodiment.
Figure 11:
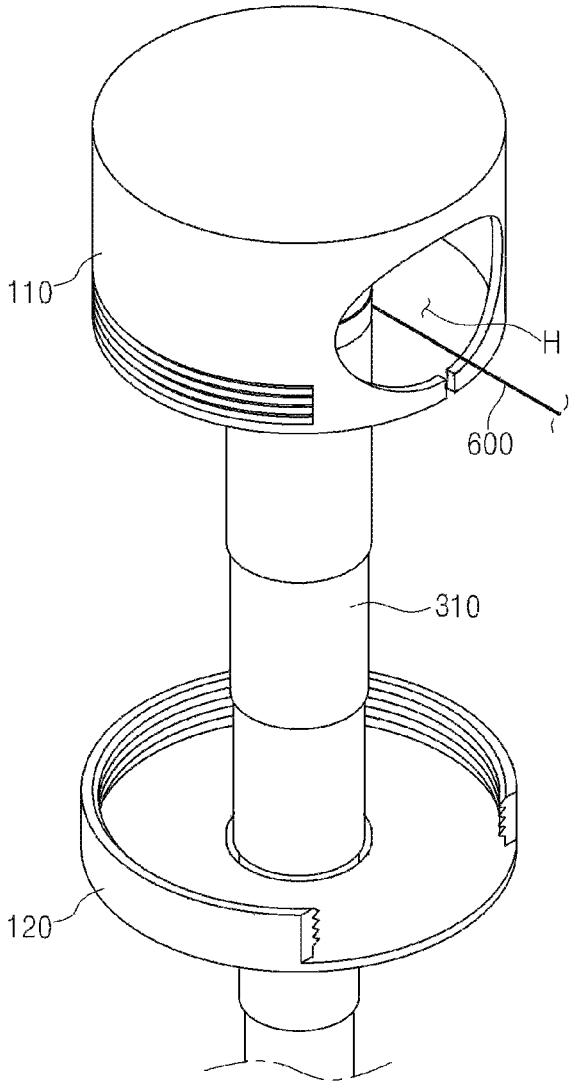
FIG. 11 is a perspective view illustrating a case and a roller in accordance with another exemplary embodiment.

FIG. 10 is a schematic view illustrating a portable compact umbrella in accordance with another exemplary embodiment. FIG. 11 is a perspective view illustrating a case and a roller in accordance with another exemplary embodiment.

The portable compact umbrella in accordance with another exemplary embodiment may include a case 100 having a different structure.

Referring to FIG. 10, a container body 110 of the case 100 in accordance with another exemplary embodiment may have an opened lower portion. The container body 110 may include a top surface and a side surface. An opening H and a slit S may be defined in the side surface of the container body 110. A lid 120 may be mounted to the lower portion of the container body 110. The lid 120 may include a bottom surface and a side surface. The side surface of the lid 120 may be partially cut to avoid structural interference with the opening H.

In the lid 110, at least a central portion of the top surface may include a magnetic material. Here, the magnetic material may include, e.g., a metal material that is attachable to a magnet. Thus, a coupling member 420 provided at a central portion of the umbrella fabric 400, which will be described later, may be attached to and detached from the container body 110 with one touch by using a magnetic force f1.

A central portion of the lid 120 may be opened, and a support 300 may be disposed in an opening of the lid 120.

In another exemplary embodiment, a user may grip the container body 110 by a left hand and easily rotate the support 300 by a right hand when accommodating an umbrella fabric 400 and an umbrella ring 500. Here, the accommodating represents that the umbrella fabric 400 and the umbrella ring 500 are wound and accommodated in an accommodation space of the case 100.

In accordance with exemplary embodiments, as the umbrella ring 500 in which one side is cut, e.g., the umbrella ring 500 having an arc-type structure, is disposed at a circumference of the umbrella fabric 400, the umbrella fabric 400 and the umbrella ring 500 may be pulled to be simply wound with the vortex shape and accommodated in the case 100 when the portable compact umbrella is stored, thereby reducing an accommodation volume of the umbrella fabric 400 and the umbrella ring 500. Thus, the user may easily carry the portable compact umbrella to have improved activity.

Also, when the portable compact umbrella is used, the umbrella fabric 400 and the umbrella ring 500 may be pushed out of the case 100 and easily unfolded, and a supporting force may increase by allowing both ends of the umbrella ring 500 to contact each other. Thus, the user may quickly and safely use the portable compact umbrella.

Figure 12:
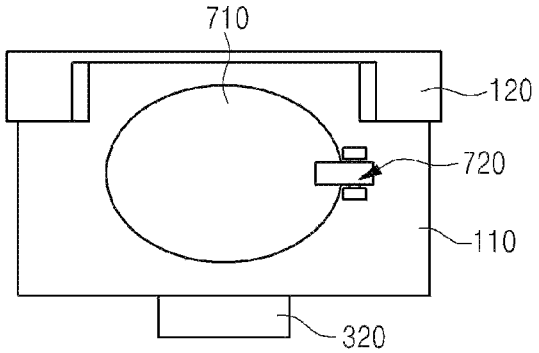
FIG. 12 is a schematic view illustrating a case and a door in accordance with a modified example.
Figure 12:
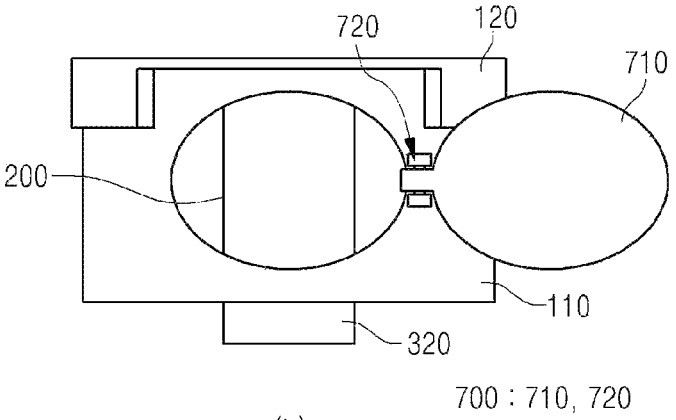

(a) and (b) of FIG. 12 are schematic views illustrating an operation state of a case and a door in accordance with a modified example.

A portable compact umbrella in accordance with the modified example may include a door 700 mounted to a container body 110 in order to open and close an opening H. Referring to FIG. 12, the door 700 may include: a door body 710 capable of covering the opening H; and a rotation member 720 mounted to connect the door body 710 to the container body 110.

The door body 710 may have a shape corresponding to that of the opening H. The door body 710 may have a circular plate shape. The door body 710 may have an area greater than that of the opening H. The rotation member 720 may be, e.g., a hinge. The rotation member 720 may be mounted to the container body 110 at a circumference of the opening H and support one side of the door body 710.

The door body 710 may be rotated with respect to the rotation member 720 to open and close the opening H. Thus, as the opening H is closed to the door body 710 after an umbrella fabric 400 and an umbrella ring 500 are wound and accommodated, moisture remained on the umbrella fabric 400 may not be discharged to the outside of the case 100.

A latch (not shown) may protrude from the other side of the door body 710 so that the door body 710 is insertion-coupled to an inner wall of the opening of the container body 110. Also, a magnetic member may be provided at the other side of the door body 710 and the inner wall of the opening of the container body 110, and the door body 710 may be fixed to the inner wall of the opening of the container body 110 by using a magnetic force.

Figure 13:
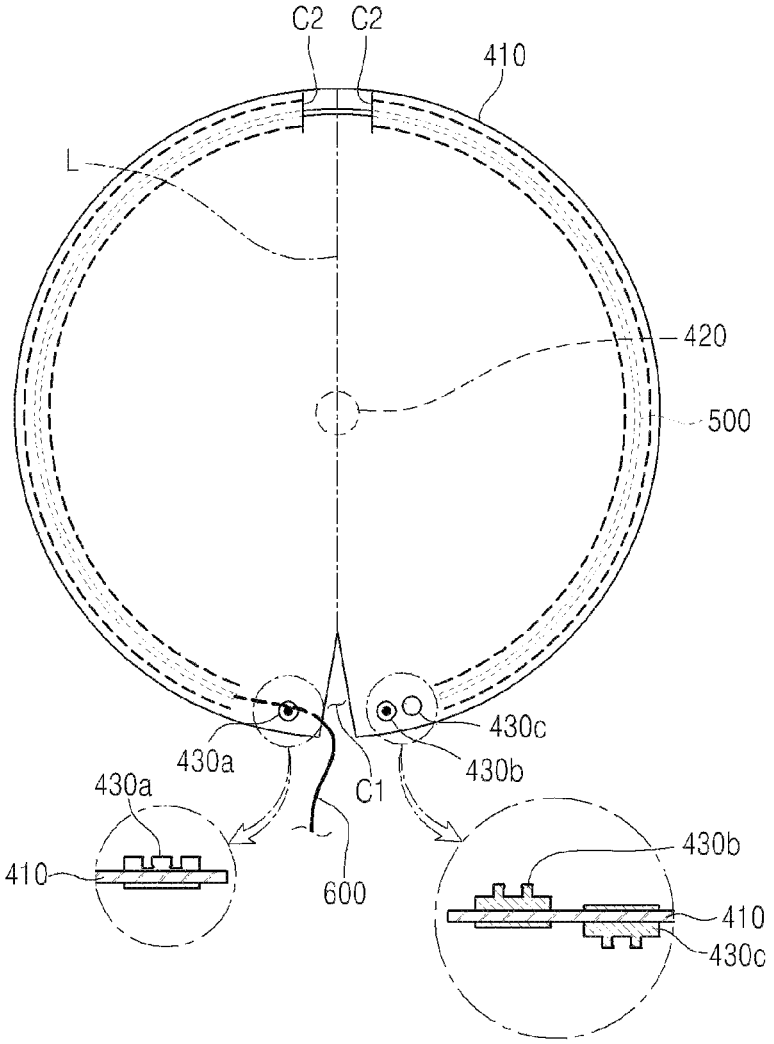
FIGS. 13 and 14 are plan views illustrating an umbrella fabric in accordance with another modified example.
Figure 14:
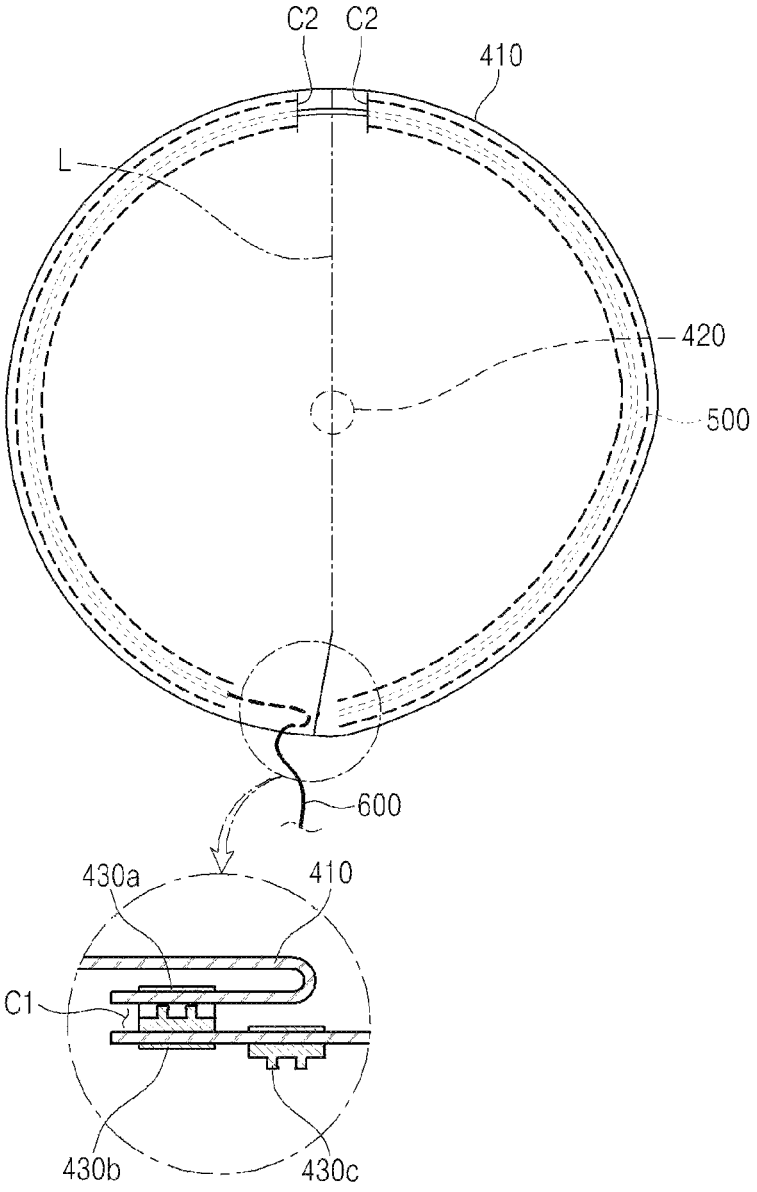

FIGS. 13 and 14 are plan views illustrating an umbrella fabric in accordance with another modified example.

In accordance with the another modified example, two fixing members may be disposed at the other side of a cut portion of a covering member 410. Here, the fixing member may be disposed on each of a top surface and a bottom surface of the covering member 410. Here, a fixing member 430*b* disposed on the top surface of the covering member 410 at the other side of the cut portion and a fixing member 430*c* disposed on the bottom surface of the covering member 410 at the other side of the cut portion may be spaced apart from each other along a circumference of the covering member 410.

As illustrated in FIG. 14, when the covering member 410 is unfolded, as one side of the cut portion is folded, a fixing member 430*a* disposed on the one side and the fixing member 430*b* disposed on a top surface of the other side of the cut portion may be attached to each other. Thus, an overlapped portion of the covering member 410 may form three layers to generate a supporting force.

Figure 15:
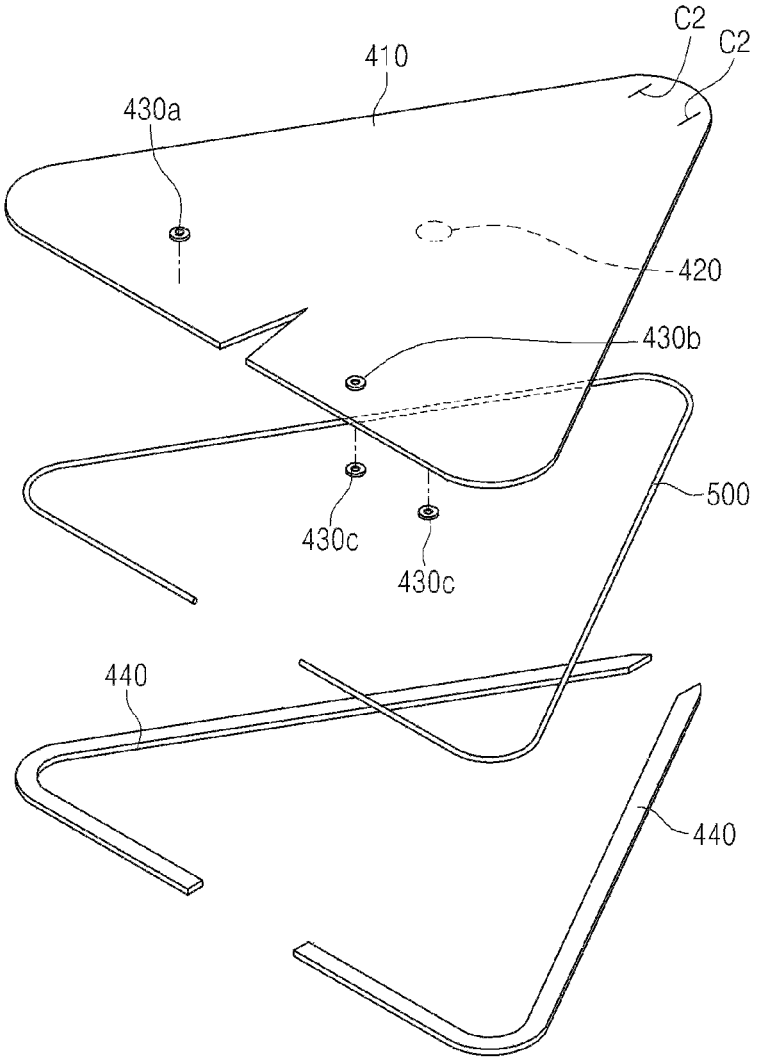
FIG. 15 is an exploded view illustrating an umbrella ring and an umbrella fabric in accordance with still another modified example.

FIG. 15 is an exploded view illustrating an umbrella ring and an umbrella fabric in accordance with still another modified example.

In accordance with the still another modified example, a planar shape of an umbrella fabric 400 when unfolded may have a triangular shape, and an umbrella ring 500 may also have a triangular shape corresponding to the shape of the umbrella fabric 400.

In this case, the umbrella fabric 400 and the umbrella ring 500 may be folded into a half size and pulled to be smoothly wound around an outer circumferential surface of a roller 200 instead of pulling a central portion of the umbrella ring 500. That is, a process of accommodating the umbrella fabric 400 and the umbrella ring 500 may be further simplified.

Figure 16:
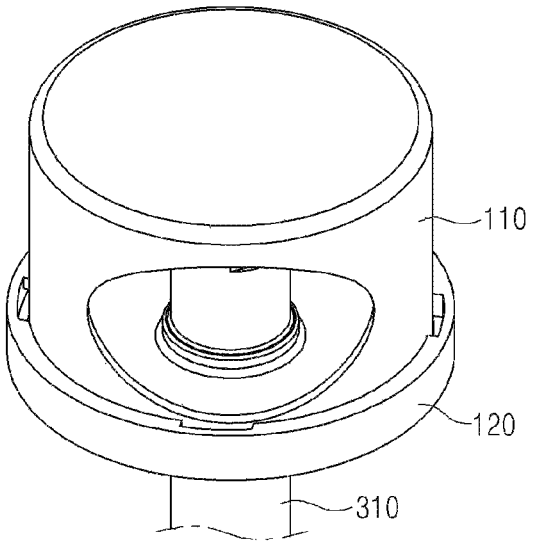
FIGS. 16 to 20 are schematic views illustrating a portable compact umbrella in accordance with yet still another modified example.
Figure 16:
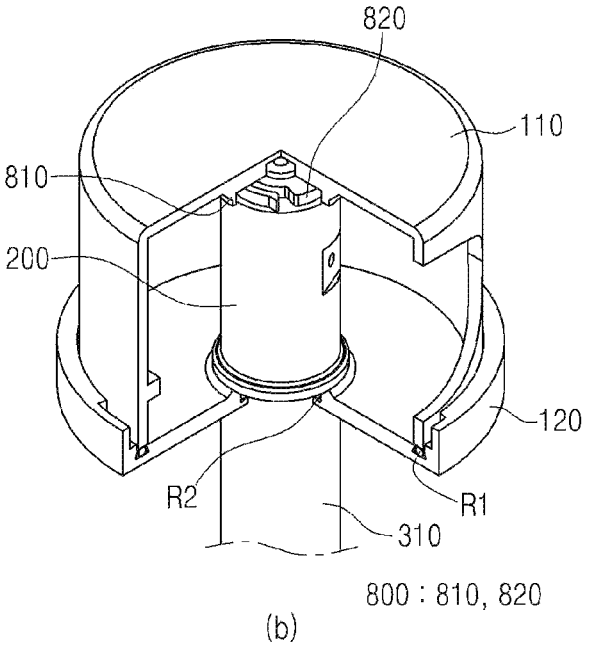

FIGS. 16 to 20 are schematic views illustrating a portable compact umbrella in accordance with yet still another modified example. (a) of FIG. 16 is a perspective view illustrating the portable compact umbrella in accordance with the yet still another modified example, and (b) of FIG. 16 is a partial cross-sectional view illustrating the portable compact umbrella in accordance with the yet still another modified example.

Figure 17:
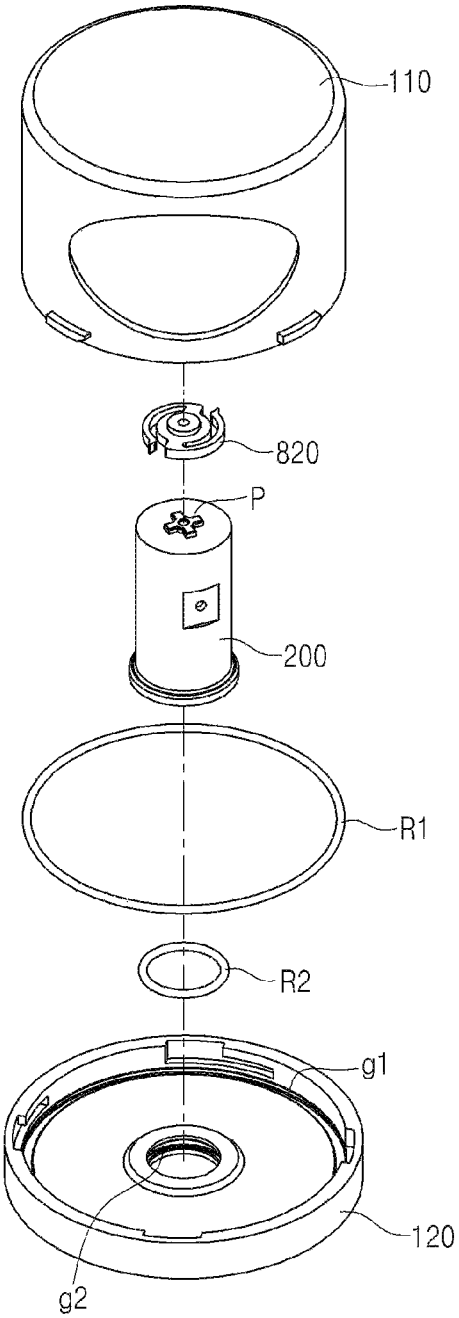
Figure 18:
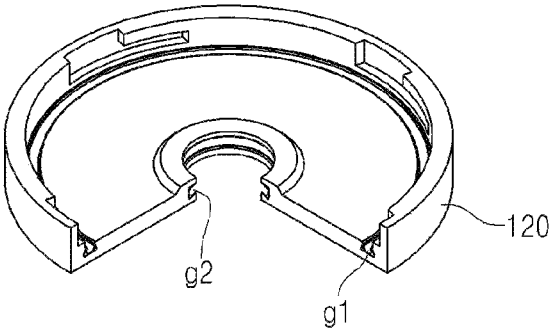
Figure 19:
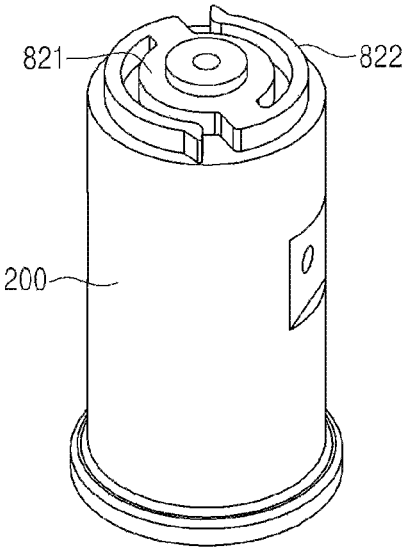
Figure 20:
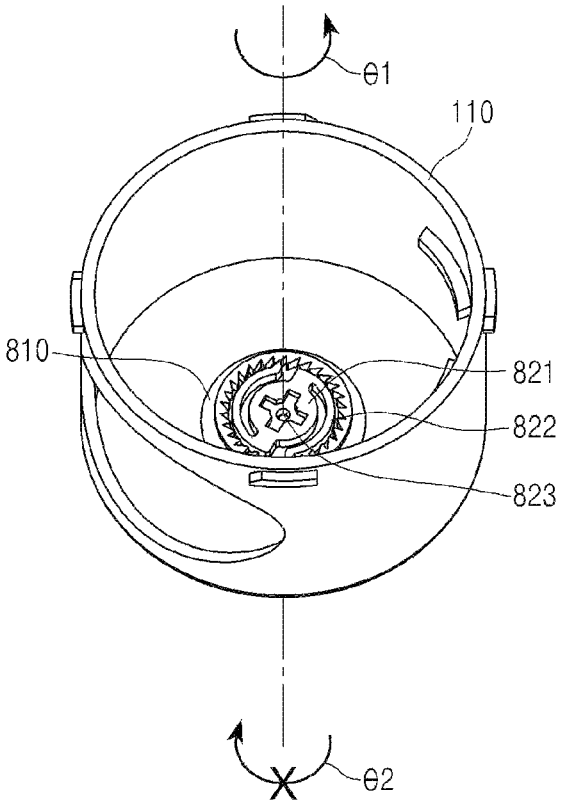

FIG. 17 is an exploded view illustrating the portable compact umbrella in accordance with the yet still another modified example, and FIG. 18 is a perspective view illustrating a lid of the portable compact umbrella in accordance with the yet still another modified example. FIG. 19 is a partially enlarged view illustrating the portable compact umbrella in accordance with the yet still another modified example, and FIG. 20 is an operation view illustrating the portable compact umbrella in accordance with the yet still another modified example.

Referring to FIGS. 16 to 20, the portable compact umbrella in accordance with the yet still another modified example may include a reverse rotation preventing part 800 installed between a roller 200 and a case 100 to prevent reverse rotation of the roller 200.

The reverse rotation preventing part 800 may have an one-way clutch structure. Here, an one-way clutch may be referred to as a free wheeling clutch or a backstop clutch. The reverse rotation preventing part 800 may include: a reverse rotation preventing clutch ring 810 formed on an inner top surface of the container body 110; and a reverse rotation preventing clutch spring 820 mounted to a top surface of the roller 200.

The reverse rotation preventing clutch ring 810 may have a ring shape formed at a central portion of the inner top surface of the container body 110, and a reverse rotation preventing gear may be formed on an inner surface thereof. The reverse rotation preventing clutch spring 820 may include: a spring main body 821 having a circular plate shape; a reverse rotation preventing cam 822 extending outward from a circumference of the spring main body 821 and having an end contacting the reverse rotation preventing gear; and an insertion groove 823 recessed from a bottom surface of the spring main body 821 and insertion-coupled with a projection p formed on the top surface of the roller 200 with a cross-shape. The reverse rotation preventing cam 822 may easily contact and climb the reverse rotation preventing gear to freely rotate in case of a forward rotation θ1 of the roller 200. In case of a reverse rotation θ2 of the roller 200, the end of the reverse rotation preventing cam 822 is engaged to the reverse rotation preventing gear to prevent reverse rotation (refer to FIG. 20).

Thus, although the user temporarily stops rotation or release a handle while the umbrella fabric 400 and the umbrella ring 500 are wound around the outer circumferential surface of the roller 200 through the forward rotation of the roller 200 in order to accommodate the umbrella fabric 400 and the umbrella ring 500, the reverse rotation preventing part 800 may prevent the reverse rotation of the roller 200 to prevent the umbrella fabric 400 and the umbrella ring 500 from being escaped out of the case 100 as the roller 200 is reverse-rotated by elasticity of the umbrella ring 500.

The reverse rotation preventing part 800 may have various configurations and methods in addition to the above-described configuration and method, and the structure of installing the reverse rotation preventing part 800 to the case 100 may be also variously provided.

Referring to FIGS. 16 to 18, the portable compact umbrella in accordance with yet still another exemplary embodiment may include a first sealing ring R1 that seals a portion between the container body 110 and the lid 120 and a second sealing ring R2 that seals a portion between the lid 120 and the roller 200. For example, a first sealing groove g1 may be defined at an edge of the lid 120, and the first sealing ring R1 may be inserted to the first sealing groove g1 and contact an upper end of the container body 110. Also, a second sealing groove g2 may be defined at a circumference of a central portion of the lid 120, and the second sealing ring R2 may be inserted to the second sealing groove g2 and contact an outer circumferential surface of the roller 200. Thus, all sorts of liquids such as rain may be prevented from being leaked to the inside and the outside of the case 100.

In accordance with the exemplary embodiment, when the umbrella is stored, the umbrella part may be easily accommodated in the case by rotating the roller installed in the case, and the accommodation volume of the umbrella part may be reduced. Also, when the umbrella is used, the umbrella part may be pulled out of the case and easily unfolded. Thus, the user may conveniently carry and use the umbrella, and the activity of the user may improve.

Although the exemplary embodiments of the present invention have been described, it is understood that the present invention should not be limited to these exemplary embodiments but various changes and modifications can be made by one ordinary skilled in the art within the spirit and scope of the present invention as hereinafter claimed.

What is claimed is:

1. A portable compact umbrella comprising:

a case having an inner accommodation space and opened one side;

a roller rotatably installed in the case;

a support having a variable length and configured to support the case; and an umbrella part accommodated in the inner accommodation space by passing through an opening at one side of the case in conjunction with rotation of the roller, wherein the umbrella part comprises:

an umbrella fabric having a size covering a body of a user;

an umbrella ring separated from the support and installed at a circumference of the umbrella fabric; and a connection rope configured to connect at least one of the umbrella ring and the umbrella fabric with the roller to interconnect the rotation of the roller with movement of the umbrella ring.

2. The portable compact umbrella of claim 1, wherein the case comprises:

a container body having an opened upper or lower portion and comprising the opening at a side surface thereof; and a lid mounted to the opened upper or lower portion of the container body.

3. The portable compact umbrella of claim 2, wherein a slit is defined in the side surface of the container body, and the slit passes through the side surface of the container body, communicates with the opening, and extends upward or downward from the opening.

4. The portable compact umbrella of claim 2, wherein the roller has an opened lower portion, passes through a central portion of a bottom surface or a top surface of the container body, and is aligned with the support.

5. The portable compact umbrella of claim 4, further comprising a reverse rotation preventing part installed between the roller and the case to prevent reverse rotation of the roller.

6. The portable compact umbrella of claim 1, wherein the support is rotated in conjunction with the roller and has at least an upper end accommodated in the roller and a lower end protruding downward.

7. The portable compact umbrella of claim 1, wherein the umbrella fabric is unfolded in a radial direction and has a central portion attached to and detached from a top surface of the case, and both sides of a cut portion, which is obtained as one side of a circumference is cut in the radial direction, overlap each other.

8. The portable compact umbrella of claim 7, wherein both sides of a top surface of the umbrella fabric overlap each other with respect to an area line passing the central portion of the umbrella fabric and the cut portion, and the umbrella fabric passes through the opening at one side of the case in conjunction with the movement of the umbrella ring and is wound around the roller to be accommodate in the inner accommodation space.

9. The portable compact umbrella of claim 7, wherein the umbrella ring is disposed on a bottom surface of the umbrella fabric, a cover fabric is provided at a circumference of the bottom surface of the umbrella fabric to cover the umbrella ring, a plurality of grooves are formed at an opposite side of the cut portion of the umbrella fabric, and a central portion between one end and the other end of the umbrella ring passes through the groove and is exposed to a top surface of the umbrella fabric.

10. The portable compact umbrella of claim 7, wherein as one side of the umbrella ring is cut, the umbrella ring has both ends that face each other.

11. The portable compact umbrella of claim 10, wherein the umbrella ring has one end disposed at one side of the cut portion of the umbrella fabric and the other end disposed at the other side of the cut portion of the umbrella fabric, and the both ends overlap each other as the both sides of the cut portion overlap each other.

12. The portable compact umbrella of claim 10, wherein the connecting rope has one end connected to at least one of one end of the umbrella ring and one side of the cut portion of the umbrella fabric and the other end connected to the roller and wound around or unwound from the roller, to pull the umbrella ring and the umbrella fabric into the case.

13. The portable compact umbrella of claim 7, wherein the umbrella part comprises:

a coupling member provided at the central portion of the umbrella fabric, and attached to and detached from the case; and a plurality of fixing members provided at both sides of the cut portion of the circumference of the umbrella fabric, respectively, and attached to and detached from each other while contacting each other.

14. The portable compact umbrella of claim 1, further comprising a door mounted to the case to open and close the opening.

* * * * *